United States Patent [19]

Thomas

[11] 3,936,517

[45] Feb. 3, 1976

[54] METHOD FOR REDUCING PARTICLE SIZE

[75] Inventor: H. Ronald Thomas, Penfield, N.Y.

[73] Assignee: Xerox Corporation, Stamford, Conn.

[22] Filed: Jan. 11, 1974

[21] Appl. No.: 432,715

[52] U.S. Cl. ..... 264/28

[51] Int. Cl.[2] ..... B05B 3/00

[58] Field of Search ..... 264/5, 28

[56] References Cited

UNITED STATES PATENTS 3,681,011 8/1972 Gazza et al. ..... 264/28

*Primary Examiner*—Robert F. White

*Assistant Examiner*—J. R. Hall

[57] ABSTRACT

A method for processing solvent soluble solids to produce micron size particles of the solids is disclosed. A solvent solution of a material such as a polymer is prepared, frozen, comminuted, and mixed under conditions of high shear with a non-solvent liquid which is miscible with the solvent but in which the polymeric material is insoluble. When the temperature of the mixture exceeds the melting point of the solvent, the solvent melts and diffuses into the non-solvent liquid and the polymeric material is caused to precipitate out of solution in the form of finely divided particles having a normal particle size distribution. The freezing and comminution of the solvent solution of polymeric material may be accomplished in a one step process in-situ by slowly adding the polymer solution to the non-solvent liquid under conditions of high shear agitation, the non-solvent liquid being maintained at a temperature substantially below the melting point of the solvent whereby dispersed droplets of the solution are caused to freeze prior to substantial diffusion of the solvent into the non-solvent liquid.

10 Claims, No Drawings

METHOD FOR REDUCING PARTICLE SIZE

BACKGROUND OF THE INVENTION

The present invention relates to an improved method for processing solvent soluble solids whereby the solids may be recovered in finely divided, particulate form. More specifically, the present invention is directed towards the preparation of an electrostatographic toner material which is suitable for use in electrostatic and xerographic processes.

It is known that images may be formed and developed on the surfaces of certain photoconductive materials by electrostatic means. The basic xerographic process, as taught by Carlson in U.S. Pat. No. 2,297,691 involves uniformly charging a photoconductive insulating layer followed by exposure of layer to a pattern of light and shadow which dissipates the charge on the portions of the layer which are exposed to light. The electrostatic latent image formed on the layer corresponds to the configuration of the light and shadow image. Alternatively, a latent electrostatic image may be formed on the plate directly by charging said plate in image configuration. This image is rendered visable by depositing on the image bearing layer a finely divided electroscopic developing material called a toner. A toner usually includes a thermoplastic resin and a colorant. The toner material will normally be attracted to those portions of the layer which retain a charge, thereby forming a toner image corresponding to the latent electrostatic image. This powder image may then be transferred to paper or other receiving surfaces, and the transferred image may be made permanent by heating using suitable fixing means. The above general process is also described in U.S. Pat. Nos. 2,357,809, 2,891,001 and 3,079,342.

Toner materials are most commonly prepared by forming an intimate mixture of a thermoplastic resin and a colorant material, and thereafter comminuting the mixture using a pulverizer, jet mill, or other device to produce particles having an average particle size within the range of about 1 to 30 microns. Other techniques for forming toner material involve the mixing of a colorant with a dispersion, solution or latex of a resinous material followed by spray drying of the mixture whereby descrete particles are formed. General techniques for preparing toner material are disclosed for example in U.S. Pat. RE25/36 and U.S. Pat. No. 3,502,582.

Other techniques for recovering materials in finely divided form include the precipitation technique and the cryogenic grinding technique. The recovery of solvent soluble solids from a solvent by the precipitation into a non-solvent involves the selection of a non-solvent for the solid and the pouring of a solvent solution of the solid into a non-solvent, normally under agitation, causing precipitation of the solid solute. Such procedures have found use in recovering all types of organic compounds including dyes, pigments, aromatic compounds, polymers and the like. Another technique for the reduction of the particle size of solids such as polymeric materials is accomplished by utilizing cryogenic grinding. This practice involves cooling the material down to a very low temperature with dry ice or liquid nitrogen and grinding it in a high shear grinder. This technique is particularly applicable for reducing the particle size of polymers having low softening points or melting points. Typical examples of these and other techniques for polymer particle size reduction are found in U.S. Pat. Nos. 271,080, 1,201,132, 2,067,971, 2,216,094, 2,879,173, and 3,379,797.

While these techniques have generally proven satisfactory in most applications, they do suffer certain disadvantages. For example ordinary mechanical methods of disintegration may cause degredation of the polymeric material accompanied by a reduction in molecular weight. The heat generated during mechanical treatment even under cryogenic conditions is often sufficient to soften the polymeric material giving rise to clogging of the grinding mechanism and destruction of the particulate character of the processed polymer. It is also difficult to precisely control the particle size of the polymeric material so processed and often subsequent screening operations are required to meet target goals in terms of particle size. With regard to the precipitation technique, target particle size goals are often difficult to reach since the solute may precipitate out of solution in the form of a difficult to recover colloid. Also, precipitated polymers having moderately low softening or melting points may have a tendency to congeal unless extremely low temperatures are maintained in the system.

It is thus most desirable to devise a simplified process for the preparation of finely divided solid materials which offers a more precise control over the particle size of the material processed thereby, and which process avoids many of the disadvantages referred to above.

SUMMARY OF THE INVENTION

An improved process for the preparation of micron size solvent soluble solid materials has now been discovered. The process involves the steps of forming a solution of a solid material in a solvent therefore, freezing said solution, comminuting said frozen solution, exposing said frozen particulate solution under conditions of high shear agitation to a liquid which is a non-solvent for said solid material, but which liquid is miscible with said solvent thereby forming a mixture of said liquid and discrete particles of said frozen solution, and allowing said frozen solvent to melt in said liquid whereby the solvent diffuses into the liquid and the solids precipitate out of solution in the form of finely divided micron sized particles. The finely divided particles may then be recovered by conventional techniques. A preferred method for carrying out the process of this invention is a simplified single step, in-situ operation whereby a solvent solution of a solid material is gradually added to the non-solvent liquid under conditions of high shear agitation, said non-solvent liquid being selected such that it has a melting point substantially lower than the melting point of said solvent and said non-solvent liquid further being maintained at a temperature substantially lower than the melting temperature of said solvent during addition of said solution. Because of the high shear agitation, the solution is caused to rapidly disperse in said liquid to form a mixture, the temperature of said liquid being such as to cause quick freezing of the dispersed solution droplets prior to any substantial diffusion of the solvent within the liquid. The temperature of the mixture of the liquid and frozen particles of the solution is then raised under continued high shear agitation to a point above the melting point of the solvent whereby the solvent diffuses into the liquid and the solids are caused to precipitate out of solution in the form of finely divided micron sized particles. The process of this invention affords the capability of preparing particles of solids, such as a polymeric material, having a normal particle size distribution and an average particle size in the order of 20 microns or less. Materials such as anthracene and polymeric materials with melting or softening points as low as 45°C. which are difficult to particulate to the desired particle size by prior art techniques can be readily processed according to the present invention. In addition, electrostatographic toner materials comprising uniform mixtures of polymeric material and other additives such as pigments, dyes and the like may be prepared by dispersing or dissolving these additives in the polymeric solution prior to processing, as will be hereinafter disclosed.

DETAILED DESCRIPTION OF THE INVENTION

In accordance with the present invention solids may be processed into finely divided micron sized particles having a normal particle size distribution and an average particle size of 20 microns or less. The invention is equally applicable to virtually any class of solids which can be made to dissolve in a solvent, which solvent is miscible with a second liquid, and in which second liquid the solid material itself is not soluble. Otherwise, the process is operable substantially independent of the physical or rheological properties of the solid material, with the exception that the softening or melting point of the solid material must not be so low that the particles congeal prior to recovery.

The selection of the particular solvent to be used in the process is dictated by at least two variables: it must be a material capable of dissolving the solid to be processed and it must be miscible with a liquid which is a non-solvent for the solid. Conversely, the selection of the non-solvent liquid is dictated by miscibility with the solvent and insolubility with the solid. Many organic solids, for example polymers, are completely soluble in aromatic or aliphatic hydrocarbons, and are substantially insoluble in organic alcohols, which alcohols are miscible with most organic solvents. Thus, non-polar materials such as benzene, toluene, kerosene, and aromatic and aliphatic hydrocarbons in general are suitable as the solvent material for many polymers, while polar materials such as aliphatic or aromatic alcohols like methanol, ethanol, propylene glycol, phenol and the like are correspondingly suitable for the non-solvent material. Where the solid to be processed is soluble in polar materials, then polar solvents such as the aforementioned alcohols or water could be used as the solvent material while non-polar hydrocarbons would be the non-solvent liquids employed in the process. Given a specific solid to be processed and also given the aforementioned parameters, the selection of specific solvent and non-solvent liquids will be evident to one skilled in the art.

An additional consideration of the above comes into play in the embodiment wherein the present process is carried out in the mode involving the freezing of the solvent solution under high shear mixing conditions in-situ in the presence of the non-solvent liquid. In this instance, the melting or freezing point of the non-solvent liquid must be substantially lower than the melting or freezing point of the solvent in which the solid is dissolved. The temperature of the non-solvent liquid must be maintained low enough during addition of the solution of solid such that dispersed droplets of the solution will freeze prior to diffusion of the solvent within the non-solvent, but not so low that the non-solvent liquid itself is caused to freeze. The in-situ mode is best facilitated by selecting as solvent materials those compounds having relatively high melting points, and as non-solvent materials those compounds with relatively low melting points. For best results, the melting point differential between the solvent and non-solvent materials should be at least 20°C, and preferably at least about 50°C, or greater. Exemplary of solvents having suitably high melting points would be benzene or water, while non-solvents having suitably low melting points would be methanol, propylene glycol, methyl-ethyl ketone, and the like.

Within the aforementioned criteria, a wide variety of solid materials may be processed in accordance with the present invention, both organic and inorganic.

Suitable examples of inorganic solids include metal salts; inorganic dyes and pigments; hydrates; oxides; phosphorous compounds; and the like. Suitable organic solids include organic dyes and pigments; naturally occuring substances such as cellulose or natural rubber; hydrocarbons such as naphthalene or anthracene; polymeric materials; and the like. Suitable polymers which may be processed according to the present invention include natural or synthetic, amorphous or crystalline materials which can be dissolved in a solvent and which are insoluble in some other liquid miscible with said solvent. Exemplary materials are polyesters; polyethers; polyolefins including monoolefin and diolefin polymers; vinyl polymers; vinylaromatic polymers; phenol or amine aldehyde condensation polymers; polysulfide and polysulfone polymers; cellulose polymers; polyamides; polyamines and the like; as well as copolymers. Where the polymeric material is to be used as a xerographic toner, especially suitable are vinyl aromatic polymers such as polystyrene and copolymers of styrene and acrylates or methacrylates; copolymers of vinyl toluene with butadiene, isoprene and the like; polyvinylacetate and copolymers of vinyl acetate with other vinyl monomers; polyalkylacrylates and methacrylates; polyesters such as polyhexamethylene sebacate; and like polymers.

The first step of the process involves the formation of a solution of the solid which may be conveniently accomplished by dispersing particles of the solid or a melt of the solid into a solvent in a suitable mixing vessel until the solid is substantially completely dissolved. The solid concentration may be from trace amounts of less than 1% up to saturation or limit of solubility levels. The ultimate particle size of the solid after processing according to the present invention may be controlled to a large extent by the concentration of the solid in the solution, with smaller particles being obtained at low concentrates and larger particles resulting from higher concentrations.

Where the processed solid material is polymeric and is to be used as a xerographic toner, an appropriate colorant material should also be finely dispersed or dissolved in the solution at this time. It is not necessary that the colorant be soluble in the solvent, but it should be dispersed therein uniformly. The colorant material used in preparing the toner composition may include any finely divided pigment or water or organic solvent soluble dye. The most common pigments used in electrostatographic toner materials are finely divided carbon black, cyan, magenta and yellow pigments. The most common dyes are the acid, basic and dispersed dyes of suitable color as are known in the art. Typical examples of suitable colorants are disclosed in U.S. Pat. No. 3,502,582. The pigment or dye should be present in an amount effective to render the toner highly colored so that it will form a clearly visible image on a recording member. Preferably for sufficient color density, the pigment is employed in an amount from about 1% to about 20% by weight, based on the total weight of the colored toner. If the toner colorant employed is a dye, quantities substantially smaller than about 1% by weight may be used.

Next, a dispersion of frozen particles of the solution in the non-solvent liquid is formed by either of two methods. The first method involves freezing the solution, comminuting the frozen solution without melting it to form finely divided particles having an average particle size preferably less than about 500 microns and subsequently dispersing the frozen particles under conditions of high shear agitation into the non-solvent liquid. This technique may be accomplished by grinding the frozen solution under cryogenic conditions in any suitable mill or pulverizer, or by impact disintegration of chunks of the frozen solution such as involved in the cold stream process. The comminuted frozen particles of solution are then admixed with a non-solvent liquid under conditions of high shear agitation in a suitable mixing device such as a Waring Blender, Kadymill or a homogenizer, and mixing continued until the solvent component of the frozen particles of solution has completely melted. As the solvent melts, it diffuses into the non-solvent liquid and the solid solute begins to precipitate out of solution in the form of finely divided particles. After diffusion is complete, the precipitated solid, or the precipitated solid composition containing a colorant, may be recovered by conventional techniques such as by decanting, filtering, spray drying and the like. In this embodiment of the process, it is not necessary that the non-solvent liquid be maintained at a temperature below the melting point of the solvent when the frozen particles of the solution are admixed therewith; in most instances, however, it is preferable that the temperature of the non-solvent liquid be low enough such that the frozen solution does not melt before it has been uniformly dispersed and ground under high shear conditions within the non-solvent liquid.

The second and preferred method for preparing a dispersion of frozen particles of the solution in the non-solvent liquid is the one step process wherein the solution is dispersed under high shear conditions into the non-solvent liquid at a temperature well below the melting point of the solvent, and the dispersed droplets frozen in-situ in the presence of the non-solvent liquid prior to any substantial diffusion of the solvent into the non-solvent. This may be carried out by first providing a quantity of the non-solvent liquid and reducing the temperature of this liquid to a point substantially below the melting point of the solvent in which the solid material is dissolved, but not so low as to cause the non-solvent liquid itself to freeze. This cooling may be brought about by employing mixing equipment having jacketed cooling, by refrigeration of the liquid, or by adding frozen carbondioxide (dry ice) or like inert materials to the non-solvent. In most cases, the amount of cooling required should be sufficient to reduce the temperature of the non-solvent liquid to below 0°C., preferably from −20°C. to −100°C. Next, the solution is slowly added to the cooled non-solvent liquid under high shear conditions. This may be accomplished by subjecting the cooled non-solvent liquid to high shear conditions in a device such as a Waring Blender, Kady Mill, or a homogenizer, and gradually adding the solution thereto. When the droplets of solution contact the cooled non-solvent liquid under these conditions, the droplets are immediately dispersed and quick frozen. After the desired amount of the solution has been added, high shear mixing of the mixture is continued for a period of time sufficient to insure that the average particle size of the dispersed frozen droplets is less than about 100 microns. At this point, the mixture is warmed either by applying external heat or by allowing the mixture to warm by means of internal frictional heat generated by continued high shear mixing. When the temperature of the mixture reaches the melting point of the solvent, the solvent diffuses into the non-solvent liquid and the solute is caused to precipitate out of solution. After diffusion and precipitation are complete, the solid solute may be recovered as indicated above.

The ratio in which the non-solvent liquid and the solvent solution are mixed in either of the above process embodiments may vary within the range of from trace amounts of solvent solution up to about 35% by weight of solvent solution based on total weight of the mixture. The concentration of non-solvent liquid must be sufficient such that the solute dissolved in the solvent will precipitate in the diffused mixture of solvent and non-solvent after the solvent has melted. In most cases, a 10 to 1 ratio of non-solvent to solvent solution has proven effective.

The following examples are illustrative of the process of this invention.

EXAMPLE 1

To 100 parts by weight of methanol was added sufficient dry ice to reduce the temperature of the methanol to approximately −50°C. The cool methanol was then added to the container portion of a Waring Blender and agitation commenced at medium speed. Ten parts by weight of a 10% by weight solution of polystyrene in benzene was then slowly added to the cold methanol. It was observed that a benzene slush formed immediately as the solution was added to the methanol. After all of the solution was added, mixing was continued until the temperature of the mixture reached about 25°C., at which point mixing was discontinued. The dispersed particles of polystyrene were then recovered by filtering the mixture and drying the residue. The polystyrene was recovered in the form of finely divided particles having an average particle size of about 14 microns and a normal particle size distribution within the range of about 4 to 40 microns.

EXAMPLE 2

An electrostatographic toner material was prepared by forming a 10% by weight solution in benzene of a 65/35 styrene/n-butyl methacrylate copolymer. About 0.1% by weight polymer of a benzene soluble cyan dye (Heliogen Blue OS) was also dissolved in the benzene. The material was processed by the same method as employed in Example 1 except that a Kady Mill was used as the high shear mixing device. The copolymer/dye mixture was recovered in the form of finely divided particles having an average particle size of about 10 microns. This toner material was tested in a copy machine marketed by the Xerox Corporation and found to produce good copy print quality.

EXAMPLE 3

In this example the particle size of anthracene which is a difficult material to comminute, was reduced from 200 microns to about 5 microns.

Anthracene having a particle size of about 200 microns was dissolved in benzene at a concentration of about 7.5 grams per 100 ml. Next, a mixture of dry ice and methanol was added to a Kady Mill. When the temperature of the methanol had reached approximately −70°C., the benzene solution of anthracene was slowly added under milling conditions until about 10% by weight based on the methanol had been added. The benzene solution was observed to crystallize almost immediately, and was subjected to continuous fracturing in the mill until the temperature of the mixture reaches about 15°C. The precipitated anthracene was subsequently recovered by filtration and dried. It was found to have an average particle size of about 5 microns and a normal particle size distribution within the range of about 2 – 20 microns.

This material may then be used in the preparation of photosensitive plates used in electrophotographic processes.

As pointed out above, the present process provides a simplified method for reducing the particle size of materials which heretofore required more complex operations and expensive equipment. It offers good control over the normal distribution of particle size. Particle size may be controlled by simply varying the concentration of solute or by varying the ratio of solvent and non-solvent liquids employed in the process. Thus, target goals in terms of particle size distribution may be achieved without resorting to subsequent screening or comminution steps.

While the invention has been described with reference to the processes disclosed herein, it is not confined to the specific embodiments set forth, and this application is intended to cover such operative modifications or changes as may come within the scope of the following claims.

What is claimed is:

1. A process for preparing solvent soluble solids in finely divided form comprising:

a. providing a solution of a solid material in solvent therefor;

b. freezing said solution;

c. comminuting said frozen solution;

d. mixing said comminuted frozen solution with a' liquid which is a non-solvent for said solid material under conditions of high shear agitation, said non-solvent being miscible with said solvent;

e. agitating said mixture such that said solvent melts and diffuses into said non-solvent and said solid precipitates out of solution in finely divided form;

f. recovering said solid in finely divided form, wherein the average particle size of said recovered solid in 20 microns or less.

2. The process of claim 1 wherein the temperature of said liquid is less than the melting point of said solvent during said mixing step.

3. The process of claim 2 wherein said solution is mixed with said liquid at a level of up to 35% by weight of the total mixture.

4. A process for preparing solvent soluble solids in finely divided form comprising:

a. providing a solution of a solid material in a solvent therefor;

b. providing a liquid which is a non-solvent for said solid material, miscible with said solvent, and which liquid is maintained at a temperature substantially below the melting point of said solvent;

c. forming a mixture of said solution and said liquid by adding said solution to said liquid under conditions of high shear agitation sufficient to rapidly disperse said solution in said liquid, the temperature of said liquid being such as to cause freezing of said dispersed solution prior to any substantial diffusion of said solvent within said liquid;

d. raising the temperature of said mixture to a point above the melting point of said solvent while continuing agitation whereby said solvent is caused to diffuse into said liquid and said solid is caused to precipitate out of said mixture in the form of finely divided particles;

e. recovering said solid in finely divided form, wherein the average particle size of said recovered solid is 20 microns or less.

5. The process of claim 4 wherein said liquid is maintained at a temperature of at least 20°C. less than the melting point of said solvent during said mixing step.

6. The process of claim 5 wherein said solution is mixed with said liquid at a level of up to 35% by weight of the total mixture.

7. The process of claim 5 wherein said solid is polymeric.

8. The process of claim 7 wherein said provided solution further includes a colorant material dissolved or finely dispersed therein.

9. The process of claim 6 wherein said liquid is maintained at a temperature of at least 50°C. less than the melting point of said solvent during said mixing step.

10. The process of claim 9 wherein said solution is mixed with said liquid at a ratio of about one part of solution per ten parts of liquid.

* * * * *